United States Patent [19]

Herbst, Sr.

[11] 3,974,969

[45] Aug. 17, 1976

[54] HIGH SPEED CHOPPER FOR PRECISION MIXERS

[75] Inventor: Clarence A. Herbst, Sr., Park Ridge, Ill.

[73] Assignee: Resinoid Engineering Corporation, Skokie, Ill.

[22] Filed: Aug. 1, 1974

[21] Appl. No.: 493,549

[52] U.S. Cl. ..... 241/98; 241/185 R; 241/292.1

[51] Int. Cl.[2] ..... B02C 13/00; B02C 18/14

[58] Field of Search ..... 241/185 R, 98, 195, 241/177, 282.1, 282.2, 292.1, 101 B, 138, 154

[56] References Cited

UNITED STATES PATENTS

| | | | |
|---|---|---|---|
| 2,854,045 | 9/1958 | Schmidt et al. | 241/292.1 X |
| 3,027,102 | 3/1962 | Lodige et al. | 241/98 |
| 3,580,315 | 5/1971 | Schnell | 241/98 X |

*Primary Examiner*—Roy Lake
*Assistant Examiner*—E. F. Desmond
*Attorney, Agent, or Firm*—Wegner, Stellman, McCord, Wiles & Wood

[57] ABSTRACT

A comminuting and/or mixing machine having a plurality of alternately aligned blades each one having plural step-like leading edges lying in a plane angularly disposed to the direction of movement of the blades. The angular disposition of the step-like edges, the relative orientation of the plural blades, the length and spacing of the blades and the speed of rotation of the unit produces a combined chopping, grinding and mixing of the materials resulting in a product of controlled particle size and of intimately mixed conglomerate.

14 Claims, 8 Drawing Figures

HIGH SPEED CHOPPER FOR PRECISION MIXERS

BACKGROUND OF THE INVENTION

1. FIELD OF THE INVENTION

This invention relates to a comminuting machine or a comminuting, grinding and mixing machine and more particularly to a machine having a chopper element for disintegrating large chunks of solid material into smaller sized particles and may be used to successively or simultaneously mix the particles with one or more additional materials.

2. DESCRIPTION OF THE PRIOR ART

Heretofore it has been necessary to provide two separate machines, one of which is used to chop or to disintegrate relatively large chunks of solid material into relatively small particles which particles must be of a size capable of passing through a screen having a particular classification of particle size. After the particles are passed through the screen, they are then put in a mixing machine wherein other materials, which may be in powder, fibrous or liquid form or any combination of these, are added and mixed to a relatively uniform conglomerate.

Even with the use of two separate units, it has been found that exceptionally long periods of time are required to grind and/or chop the chunks of solid material into the desired particle size. The product resulting from the grinding operation usually contains a high proportion of material of a size that is classifiable as dust which becomes airborne at the slightest agitation such as results from removing the pulverized material from the grinder and putting it into the mixer. In addition, the expense involved in taking the properly sized material and recycling it through a second machine to mix it with one or more additional materials requires a considerable outlay in equipment and space as well as requiring special material handling apparatus.

SUMMARY OF THE INVENTION

The present invention is directed to the unique design of a blade member which may be assembled with one or more additional blade members in a particular orientation so that when used with appropriate agitators will not only grind and chop chunks of solid material into reduced particle size, but also will mix the ground material with additional materials so that in the one machine the grinding and mixing steps may be combined.

The blade member has a step-like cutting section formed in the leading edge of the outer portion of the blade with the steps progressing toward the rear edge of the blade and, when assembled on the blade drive shaft, the cutting section is oriented away from the wall of the mixing chamber. The design and orientation of the cutting section is such that the chunks of solid material will receive impacts therefrom and will be reduced in size as they are not only hurled away from the wall of the chamber but also, when plural blades are used, are hurled into the path of and randomly into contact with adjacent similarly oriented blades on the grinding shaft. The blade or blades when assembled on the grinding shaft are, in one form of the invention progressively longer as the distance from the wall into the center of the chamber increases and each immediately adjacent blade is positioned approximately 45° to 90° from the preceding blade. The progression of length avoids contact of the shaped wings on the mixer arms which are mounted on the center mixer shaft. Spacers are provided for spacing the blades from the wall of the chamber and from adjacent pairs of blades so as to produce the desired chopping and/or grinding function.

Since the comminuting is performed in a closed mixer-type piece of equipment, the dust and powder generated during the grinding and/or mixing operation is confined to the inside of the equipment thus eliminating the pollution problems that existed heretofore.

DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENT

Figure 1:
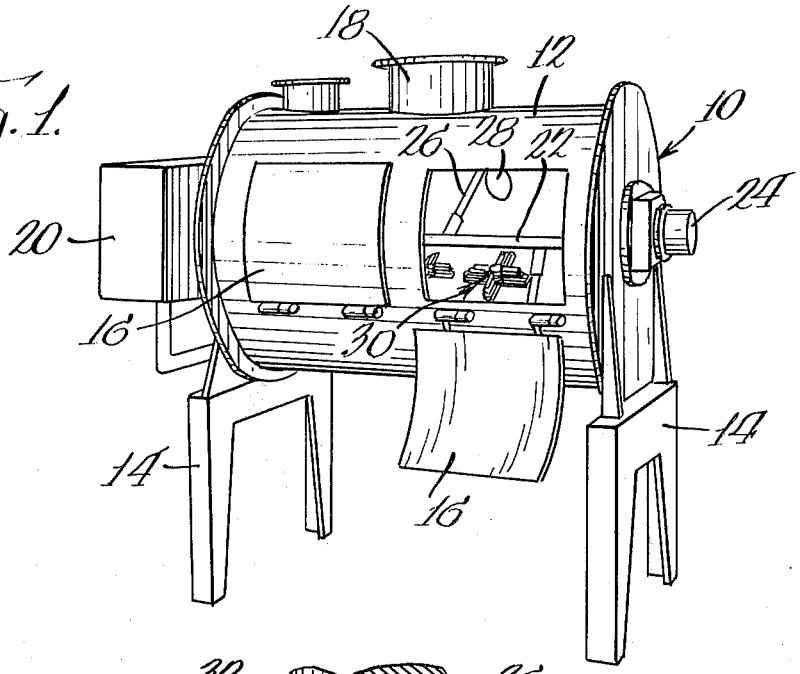
FIG. 1 is a perspective view of a comminuting and mixing unit with a set of the improved blades mounted therein.
Figure 2:
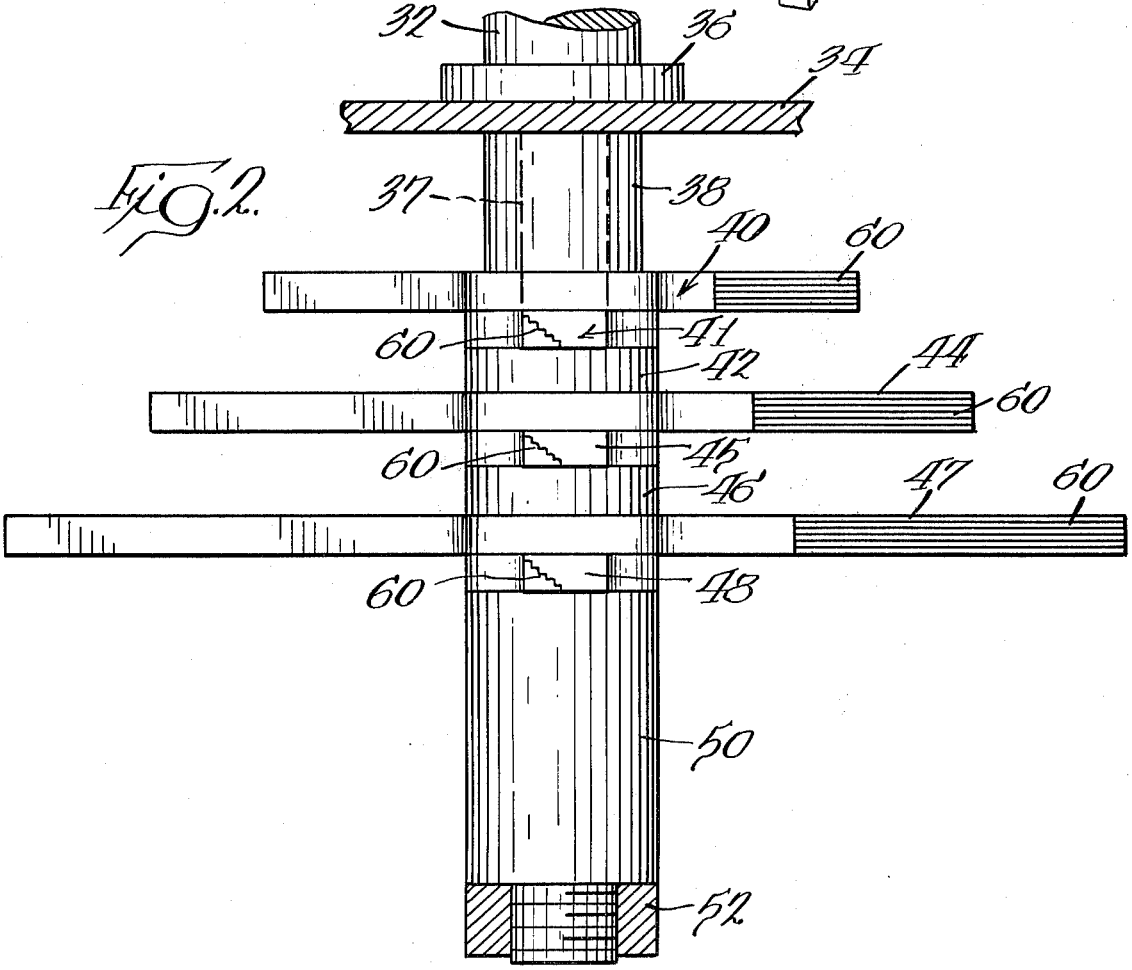
FIG. 2 is a plan view of the grinding shaft having a set of preferred form of blades mounted thereon.
Figure 3:
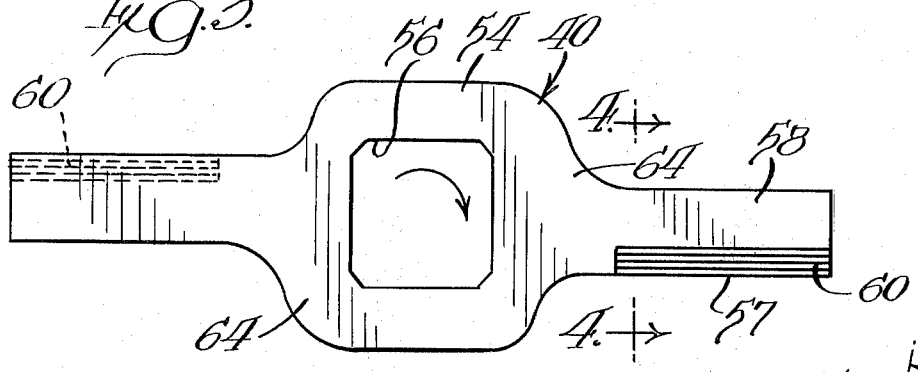
FIG. 3 is a plan view of one of the improved blades showing the step-like grinding edges on the outer portion thereof.

A preferred form of the invention is shown in FIGS. 2 and 3 and will be described with respect to a presently, commercially available mixer such as shown somewhat schematically in FIG. 1. A typical piece of equipment that is susceptible of use with my invention is manufactured and sold by the Littleford Bros. Inc. of Cincinnati, Ohio and is identified as a Littleford Lodige Precision Mixer. The grinder and/or mixer 10 has a cylindrical tank or drum 12 mounted on its side on supports 14. The tank or drum has access or clean-out openings 16 in the side walls thereof with a vertical stack-like filling opening 18 for use in the insertion of chunk or block shaped coarse materials therein. The tank or drum 12 has a motor, gear drive, and control unit 20 mounted on one end portion which unit drives and controls the speed with which the mixing and agitating arms 26 in the tank are driven. A rotatable rod 22 which carries the mixing arms 26 in the drum is mounted on one end in bearings 24 on the end of the drum 12 opposite to the unit 20 with the appropriate end of the shaft connected to the output of the gear drive. The rod 22 and mixing arms 26 are driven at a certain predetermined rate of speed. One or more mixing arms 26 are carried by the rod 22 and have on the outer end thereof shaped wings 28 such that as the rod 22 is rotated, the shaped wings 28 will agitate the solid material in the tank or drum and will throw the material into the path of the improved comminuting or grinding means 30.

Referring to FIGS. 1-3, the comminuting or grinding, chopping and/or mixing means 30 is illustrated and consists of a rotatably driven drive shaft 32 which passes through the sidewall 34 of the tank or drum 12 and is mounted thereon by a bearing and sealing member 36 such that a motor (not shown) or the like can rotate the shaft 32 at variable rates of speed depending upon the materials and the conditions under which the equipment 10 is being operated. The drive shaft 32 has that portion 37 projecting inside the drum 12 formed in a square cross section in the plane perpendicular to the axis thereof with the corners of the square angled or rounded slightly. The distal or most exposed end portion of the shaft is round and has threads 39 formed thereon. A spacer member 38 is fit over the shaft 32 and is positioned in close proximity to the inner wall 34 in the drum.

Figure 4:
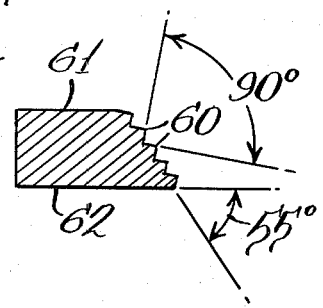
FIG. 4 is a cross-sectional view taken along the lines 4—4 of FIG. 3.

Mounted on and keyed to the square portion 37 of the shaft 32 is one or more blade means selectively in contact with an adjacent blade and selectively separated by spacers so that when bolted to the shaft and driven by the power means, grinding, chopping and/or mixing of material in the drum results. Each individual blade 40, such as shown in FIGS. 3 and 4, is formed of a very durable material such as case hardened steel and comprises a mid or mounting portion 54 with a substantially square opening 56 therethrough for receiving the squared portion 37 of the shaft 32. A pair of radially extending arms 58 are formed integrally with the mounting portion 54 and are in axial alignment with each other on the opposite sides of the center of said opening 56. On the forward or leading edge 57 of the outer portions of the arms 58 is formed a step-like grinding or cutting section having a plurality of edges or teeth 60 which are shown in cross section in FIG. 4, as being sloped at a slight angle with respect to the top and bottom faces or surfaces 61, 62 of said arm 58. Each cutting edge 60 has a substantial length lying substantially parallel to the leading edge 57 of the arm 58 and, as viewed in cross section, fall in a line or plane which subscribes an angle of approximately 55° with the plane of the bottom face or surface 62 of said arm 58. As a practical matter, each individual cutting edge 60 does not have to lie precisely in the common plane but for discussion purposes will be assumed to lie generally in a plane that subscribes the angle indicated with respect to the bottom face or surface 62 of the arm 58. The surfaces that go to make up each cutting or grinding edge 60 lie at an angle of approximately 90° to each other with one said surface projecting toward the plane of the bottom face or surface 62 in such a way that the edges 60 act as a wedge or splitting element as it engages the blocks or chunks of solid material being reduced in size. It will be noted in FIG. 3 that there is a substantial portion of the planar top and bottom faces 61, 62 of the arms 58 rearward of the cutting or grinding edges 60 and it has been found that radially oriented grooves, not shown, may be formed in said planar faces which will have an additional grinding or chopping affect on the particles of solid material being reduced in size.

It has been found in practice that the individual blades 40 should be balanced from side-to-side and from end-to-end so as to avoid vibrations and the like that could cause damage to the blades and to the equipment. In keeping therewith, it should be noticed that additional material is provided in the areas 64 to compensate for the reduction in material caused by the forming of the cutting edges in the opposite side of the arm 58.

Figure 5:
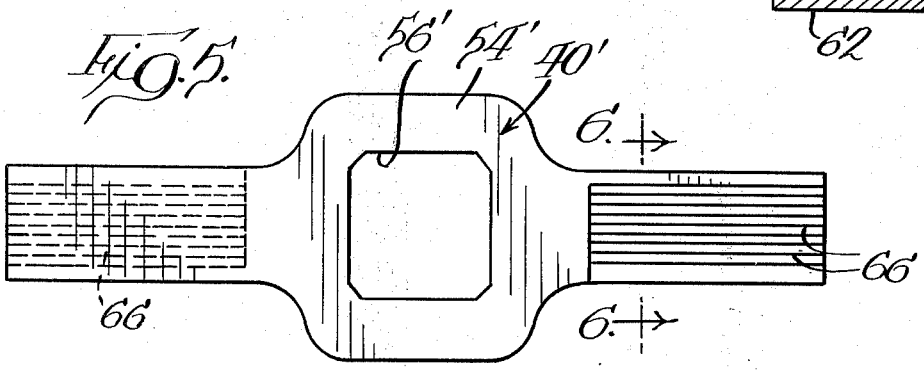
FIG. 5 is a modified form of blade showing the step-like grinding edges oriented at a different angle with respect to the blade faces.
Figure 6:
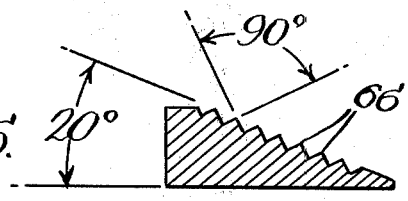
FIG. 6 is a cross-sectional view taken along the lines 6—6 of FIG. 5.

It has been found that certain modifications may be made to the design shown and described in FIGS. 3 and 4 to accomplish an intended grinding and mixing function and in some cases certain designs operate more effectively with certain types of materials then with others. For instance, in FIGS. 5 and 6, the angle formed by the plane containing the cutting edges 66 forms an angle of approximately 20° with respect to the plane of the bottom face or surface of the arms of the cutter blade 40'. The surfaces that go to make up each cutting edge 66 form an angle of approximately 90° with one of said surfaces lying at an angle approximately equal to 20° to the bottom face or surface of said blade such that said cutting or grinding edge 66 will exercise a shearing action on the blocks or chunks of solid material being reduced in size.

Figure 7:
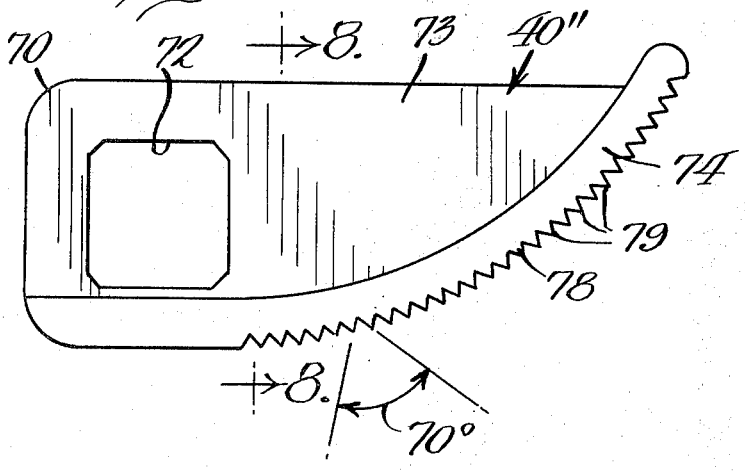
FIG. 7 is another modified form of blade with the cutting edges oriented in a different fashion; and, FIG. 8 is a cross-sectional view taken along the lines 8—8 of FIG. 7.
Figure 8:
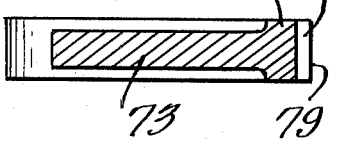

FIGS. 7 and 8 show still a third form of cutter blade 40'' having a mounting portion 70 with a substantially square opening 72 therethrough for engaging with and keying to the shaft 32. A single arm 73 extends radially outward from the portion 70 in one direction and has one edge formed in a curved or arcuate shape with an axially enlarged leading edge portion 74 having axially oriented grinding or cutting teeth 78 facing in the direction of movement of the blade. The plane containing the cutting edges 79 of said teeth 78 is generally of an arcuate shape extending outwardly from the mounting portion 70 thereof. The cutting edges 79 extend along a line substantially parallel to the axis of the shaft passing through the opening 72 with the faces of each cutting tooth subscribing an angle of 70° with respect to each other.

It has been found that the relative angle of the plane containing the cutting teeth with respect to a planar face of the blade can be varied with maximum results being found when the planar angle is approximately 45°. It has also been found that the grinding or cutting edges may be staggered or may be alternately extending and recessed or lie in an arcuate path without materially affecting the results obtained.

In FIG. 2, the portion 54 of the blade, such as blade 40, is assembled on the square portion 37 of the shaft 32 with the arms 58 extending radially outward therefrom and with the plane of the cutting edges 60 oriented toward the central portion of the drum 12. The second blade 41 is rotated 90° from blade 40 and is assembled on the shaft 32 with portion 54 engaging portion 54 of blade 40 and with the arms 58 projecting radially outward at a 90° angle with respect to the arms 58 of blade 40. A spacer 42 is assembled on the shaft 32 and bears against the second cutter blade 41 and is contacted by a third cutter blade 44 which has arms 58 with longer axial length than the first and second cutter blades 40, 41 but is oriented in the same direction and is spaced from said first cutter blade 40. A fourth cutter blade 45 is substantially identical to the cutter blade 44 and is mounted on the shaft 32 against portion 54 of blade 44 and in a position oriented 90° from said cutter blade 44 and is parallel to and spaced from the second cutter blade 41. A spacer 46 bears against cutter blade 45 and against a fifth cutter blade 47 which is substantially identical to cutter blade 44 but has arms 58 with longer axial length so as to project beyond the outer limits of blade 44. Blade 47 lies parallel to and is spaced from cutter blade 44. A sixth cutter blade 48, which is substantially identical to cutter blade 47, is oriented 45° to 90° from blade 47 and is juxtaposed and in contact with the center portion of blade 47. An axially elongate spacer 50 bears against blade 48 and is secured thereagainst by means of the nut 52 threaded on the outer threaded end portion of the shaft 32.

In a typical installation, such as shown in FIG. 2, six blades are mounted on the shaft 32 with spacers between each pair of blades and between the innermost blade and the wall 34 of the drum 12. The innermost pair of blades 40 and 41 are shorter than the immediately successive blades 44 and 45 which, in turn, are shorter than the outermost blades 47 and 48. This design permits the mixing arms 26 to clear the outer edges of the cutter blades and still provide cutting edges as close to the edges of the mixing arms as is possible. Each of the cutting edges of the blades 40, 41, 44, 45, 47 and 48 face in the same general direction and act to throw or propel the materials coming in contact therewith outward and/or forward with respect to the cutting edges of the blade in which it has come into contact. In this way, there is a tendency to keep the material from settling along the surface of the wall 34 of the drum 12 and to expose each particle to as many impacts with the cutting edges as is possible.

It has been found that the axial length of the spacers 42 and 46 will have a direct bearing on the size of the particles resulting from the grinding operation. That is, by eliminating the spacers 42 and 46, another set of blades can be accommodated on the shaft so that a finer particle size results from the grinding operation. It has also been found that if the angle of the plane containing the cutting edges of alternate blades, i.e. blades 41, 45 and 48, is reversed so as to generally point in the opposite direction from the facing direction of blades 40, 44 and 47, a very effective grinding operation is produced, although some additional agitation is necessary to keep the particles in motion as they are propelled out of the area of maximum influence of the cutting edges of the blades.

Various combinations of shorter and longer blades may be assembled together and various numbers of blades may be used depending upon the type of material being comminuted and the time in which the material must be ground to a particular particle size. For instance, four or more pairs of blades may be mounted on the shaft and it has been found that as few as one blade accomplishes the comminuting function but the time required to produce the desired results is uneconomical.

In a typical comminuting and/or mixing operation, a material such as a phenolic resin in relatively coarse and large chunks were put into the drum 12 through the filling opening 18. The clean-out access doors 16 were securely closed and the motors driving the mixing arms 26 and the grinding blades 30 were actuated. The blades were driven at approximately 3,500 rpm as the mixing arm sweeps the chunks of solid material into contact therewith. The blades comminuted or ground, chopped and sliced through the chunks of solid material propelling them from contact with, for instance, the cutting edges of blade 40 into the path of the cutting edges on blade 44 and the like. After thirty minutes, the machine was shut off and the size of a random sample of the particles in the drum was checked and 97½% was found to pass a 60 mesh screen. The access doors were then closed and one or more additional solid materials such as chunks of asbestos material was added through the filling opening and the mixing arms and cutter blades were again actuated. The cutter blades exfoliate the pressure packed asbestos and continued to chop and grind the particles of the phenolic resin as the two materials were mixed. After a period of approximately eight minutes, the mixture in the drum was checked and it was found to be a thoroughly satisfactory, uniform mixture.

I claim:

1. In a comminuting machine comprising: a drum, motor means mounted on the drum, a rotating rod means in said drum operatively connected to and driven by said motor means, and impeller means carried by the rod means for sweeping the internal area of the drum, in combination with rotating means projecting radially into the drum through a wall thereof in position to contact material swept by said impeller, said rotating means comprising a shaft, at least one blade member mounted on said shaft, said blade member having a pair of arms projecting radially outward from said shaft, each of said arms having a top forwardly facing impacting edge, a bottom forwardly facing impacting edge and at least one intermediate forwardly facing impacting edge between said top and bottom edges for contacting and disintegrating the material into smaller particle sizes and said top impacting edge, bottom impacting edge and at least one intermediate impacting edge on each of said arms lie in a plane disposed at an acute angle with respect to a top or a bottom surface of said arm.

2. In the comminuting machine of claim 1 wherein each said plane containing said impacting edges is disposed at an angle of between 15° and 55° with the plane of said top or bottom surface of said arm.

3. In the comminuting machine of claim 2 wherein two blade members are mounted on the shaft with the arms of one blade member mounted at right angles to the arms on the other blade member.

4. In the comminuting machine of claim 2 wherein the plane containing the impacting edges of one arm forms an acute angle with the bottom surface of the arm and the plane containing the impacting edges of the other arm forms an acute angle with the top surface of the arm.

5. In the comminuting machine of claim 2 wherein six blade members are mounted on the shaft with the arms of each blade member being mounted at right angles to the arms of the adjacent blade member.

6. In a comminuting machine comprising: a drum, impeller means in the drum for sweeping the internal surfaces of the drum, a shaft projecting into the drum and supporting plural blade means thereon, said blade means being mounted in position with respect to the impeller means to contact materials swept by said impeller means, said blade means comprising six blade members, each of said blade members having a mounting portion and at least one radially extending arm portion, the first and second blade members being mounted on the shaft with the mounting portions in contact with each other and with said arm portion of one blade member being at right angles to the arm portion of the other blade member, said first and second blade members being spaced from the wall of said drum and being spaced from the third and fourth blade members, said third and fourth blade members being mounted on the shaft with the mounting portions in contact with each other and with said arm portions of one blade member being disposed at right angles to the arm portion of the other blade member, and said fifth and sixth blade members being spaced from the third and fourth blade members and being mounted on the shaft with the mounting portions in contact with each other and with said arm portion of one blade member being disposed at right angles to the arm portion of the other blade member, each of said arm portions having a top impacting edge, a bottom impacting edge and at least one intermediate impacting edge, said impacting edges being substantially parallel to each other and being formed in the leading edge portion thereof.

7. In the comminuting machine of claim 6 wherein spacers are mounted on the shaft between the wall and said first blade member, between the second and third blade members and between the fourth and fifth blade members.

8. In the comminuting machine of claim 6 wherein said impacting edges on the leading edge of each of said arms lie generally in a plane which subscribes an acute angle with respect to the bottom surface of said arm.

9. In the comminuting machine of claim 6 wherein said blade member has a pair of arms extending diametrically opposite to each other.

10. In a comminuting machine comprising: a drum, impeller means in the drum for sweeping the internal surfaces of the drum, a shaft projecting into the drum and supporting plural blade means thereon, said blade means being mounted in position with respect to the impeller means to contact materials swept by said impeller means, said blade means comprising six blade members, each of said blade members having a mounting portion and at least one radially extending arm portion, the first and second blade members being mounted on the shaft with the mounting portions in contact with each other and with said arm portion of one blade member being at right angles to the arm portion of the other blade member, said first and second blade members being spaced from the wall of said drum and being spaced from the third and fourth blade members, said third and fourth blade members being mounted on the shaft with the mounting portions in contact with each other and with said arm portions of one blade member being disposed at right angles to the arm portion of the other blade member, said fifth and sixth blade members being spaced from the third and fourth blade members and being mounted on the shaft with the mounting portions in contact with each other and with said arm portion of one blade member being disposed at right angles to the arm portion of the other blade member, each of said arm portions having plural, substantially parallel impacting edges formed in the leading edge portion thereof, each said blade member has said arm radially extending from said mounting portion with said leading edge of each arm subscribing an arcuate curve generally in the plane of said blade, and said impacting edges comprises a plurality of cutting edges with each edge being subtantially parallel to a longitudinal axis of said shaft.

11. The comminuting and mixing machine comprising: a drum, motor means mounted on the drum, means in said drum operatively connected to and driven by said motor means for sweeping the internal area of the drum, and means projecting radially into the drum through the wall thereof, said last-named means comprising a shaft and at least two blade members mounted on the shaft at right angles with respect to each other, each blade member having angled step-like comminuting and mixing edges in the leading edge of the outer portions thereof for contacting and disintegrating chunks of solid material into smaller particle sizes, said blade members are spaced from the walls of said drum and the step-like edges of each blade member lie in a plane forming an acute angle with the bottom surface of said blade member and are oriented away from said walls of said drum.

12. The comminuting and mixing machine of claim 11 wherein at least four blade members are mounted on said shaft with every other blade member being oriented 90° with respect to its immediately adjacent blade member and wherein the blade members, more remote from the wall of the drum, have portions that extend further from the shaft than the blade member nearer said wall.

13. In a comminuting machine comprising: a drum, motor means mounted on the drum, a rotating rod means in said drum operatively connected to and driven by said motor means, and impeller means carried by the rod means for sweeping the internal area of the drum, in combination with rotating means projecting radially into the drum through the wall thereof in position to contact material swept by said impeller, said rotating means comprising a shaft and six blade members mounted on the shaft, each blade member having a pair of arms projecting radially outward from said shaft, the arms of each blade member being mounted at right angles to the adjacent blade member, each arm having impacting edges in the leading edge of the outer portion thereof for contacting and disintegrating the material into smaller particle sizes, said impacting edges on each arm lie in a plane disposed at an angle of between 15° and 55° with respect to the plane of a top or a bottom surface of said arm and the pair of blade members nearest the wall of the drum are shorter than the next adjacent pair of blade members.

14. In the comminuting machine of claim 13 wherein the pair of blade members most remote from the wall of the drum are longer than the four blade members closer to the wall of the drum.

* * * * *